US010787836B2

(12) United States Patent
Jung et al.

(10) Patent No.: US 10,787,836 B2
(45) Date of Patent: Sep. 29, 2020

(54) TENT POLE

(71) Applicant: DONG-IN ENTECH CO., LTD., Gyeonggi-do (KR)

(72) Inventors: In Soo Jung, Gyeonggi-do (KR); Dong Hwan Kim, Gyeonggi-do (KR)

(73) Assignee: DONG-IN ENTECH CO., LTD., Gyeonggi-do (KR)

( * ) Notice: Subject to any disclaimer, the term of this patent is extended or adjusted under 35 U.S.C. 154(b) by 0 days.

(21) Appl. No.: 16/514,653

(22) Filed: Jul. 17, 2019

(65) Prior Publication Data

US 2020/0024863 A1 Jan. 23, 2020

(30) Foreign Application Priority Data

Jul. 20, 2018 (KR) ..... 10-2018-0084904
Jan. 29, 2019 (KR) ..... 10-2019-0011292

(51) Int. Cl.
*E04H 15/60* (2006.01)
*E04H 15/44* (2006.01)

(52) U.S. Cl.
CPC ..... *E04H 15/60* (2013.01); *E04H 15/44* (2013.01)

(58) Field of Classification Search
CPC ..... E04H 15/60; E04H 2015/326; Y10T 403/7052; Y10T 403/55; Y10T 403/32991; Y10S 135/909; A01K 87/02
USPC ..... 403/292
See application file for complete search history.

(56) References Cited

U.S. PATENT DOCUMENTS 2,379,577 A * 7/1945 Harsted ..... H01Q 1/088 52/110
3,447,549 A * 6/1969 Cunningham ..... E04H 15/42 135/114
3,947,141 A * 3/1976 Casset ..... A01K 87/02 403/109.8
4,441,273 A * 4/1984 McMickle ..... A01K 87/02 43/18.1 CT
6,286,531 B1 * 9/2001 Joo-Tai ..... E04H 15/40 135/114

(Continued)

FOREIGN PATENT DOCUMENTS

JP 3549156 8/2004
KR 20-0182874 5/2000

(Continued)

OTHER PUBLICATIONS

Office Action issued by Korean Intellectual Property Office dated May 27, 2020.

*Primary Examiner* — Noah Chandler Hawk
(74) *Attorney, Agent, or Firm* — IP & T Group LLP

(57) ABSTRACT

The present invention relates to a tent pole, and each of a first pole and a second pole forming a tent pole according to an aspect of the present invention includes a main pipe, an expanded pipe portion having an increased internal diameter from one end of the main pipe, an insert connector which is insertion-coupled to the other end of the main pipe and includes one portion exposed at an outside of the main pipe, the other end of the main pipe of the second pole is inserted into the expanded pipe portion of the first pole, and the insert connector of the second pole passes through the expanded pipe portion and is inserted into the main pipe of the first pole at a predetermined depth.

7 Claims, 5 Drawing Sheets

(56) References Cited

U.S. PATENT DOCUMENTS

| | | | | |
|---|---|---|---|---|
| 6,382,223 | B1 * | 5/2002 | Lah | E04H 15/34 135/114 |
| 6,557,572 | B2 * | 5/2003 | Lah | E04H 15/48 135/114 |
| 8,813,768 | B2 * | 8/2014 | Lee | E04H 15/60 135/114 |
| 2003/0089390 | A1 * | 5/2003 | Seo | E04H 15/60 135/127 |
| 2006/0185705 | A1 * | 8/2006 | Lah | E04H 15/60 135/120.3 |
| 2006/0233599 | A1 | 10/2006 | Lah | |

FOREIGN PATENT DOCUMENTS

| | | | |
|---|---|---|---|
| KR | 20-0225982 | | 6/2001 |
| KR | 20-0267964 | | 3/2002 |
| KR | 20-0304809 | Y1 | 2/2003 |
| KR | 10-2006-0094261 | | 8/2006 |
| KR | 10-2007-0039844 | A | 4/2007 |

* cited by examiner

| | Specimen Label | Maximum Load (kgf) | Load at Yield (kgf) |
|---|---|---|---|
| 1 | S1 | 40.06 | 40.06376 |
| 2 | S1 | 39.43 | 39.42678 |
| Mean | | 39.75 | 39.74527 |
| Standard Deviation | | 0.45041 | 0.45041 |
| Coefficient of Variation | | 1.13324 | 1.13324 |
| Median | | 39.75 | 39.74527 |
| Range | | 0.64 | 0.63697 |

| | Specimen Label | Maximum Load (kgf) | Load at Yield (kgf) |
|---|---|---|---|
| 4 | S3 | 22.62 | 22.57767 |
| 5 | S3 | 24.08 | 24.08024 |
| 6 | S3 | 25.09 | 25.09226 |
| 7 | S4 | 37.82 | 37.82463 |
| 8 | S4 | 37.25 | 37.24859 |
| 9 | S4 | 35.02 | 35.02176 |
| Mean | | 33.85 | 33.84526 |
| Standard Deviation | | 7.72709 | 7.73390 |
| Coefficient of Variation | | 22.82783 | 22.85076 |
| Median | | 37.25 | 37.24859 |
| Range | | 18.89 | 18.92585 |

TENT POLE

CROSS-REFERENCE TO RELATED APPLICATION

The present application claims priority to Korean Patent Application Numbers 10-2018-0084904 filed on Jul. 20, 2018 and 10-2019-0011292 filed on Jan. 29, 2019, in the Korean Intellectual Property Office, the entire disclosure of which is incorporated by reference herein.

BACKGROUND

Field of Invention

The present invention relates to a tent pole.

Discussion of Related Art

Generally, a tent includes a waterproof cloth and a plurality of poles for camping or temporarily staying outdoors and is formed to have a predetermined form by assembling the poles to each other.

Poles for a tent (hereinafter, tent pole) forms a framework to form a space inside a tent covered by a waterproof cloth being spread, and is typically formed in a cylindrical pipe form. One tent pole may be formed by coupling a plurality of poles manufactured of a high strength aluminum tube, a fiber reinforced plastic (FRP) tube, a steel tube, or the like.

The tent pole should maintain a state in which the poles are stably coupled to each other.

However, in a case in which the tent pole is bent when the tent is assembled, a continuous and repetitive bending force may be generated. Accordingly, a tensile force may be generated at a joint portion between the poles to increase a possibility of crack and damage occurrence.

SUMMARY

The present invention is directed to providing a tent pole including a joint portion with improved strength.

According to an aspect of the present invention, there is provided a tent pole, and each of a first pole and a second pole forming the tent pole includes a main pipe, an expanded pipe portion having an increased internal diameter from one end of the main pipe, an insert connector which is insertion-coupled to the other end of the main pipe and includes one portion exposed at an outside of the main pipe, the other end of the main pipe of the second pole is inserted into the expanded pipe portion of the first pole, and the insert connector of the second pole passes through the expanded pipe portion and is inserted into the main pipe of the first pole at a predetermined depth.

The tent pole may further include an inclined portion which is provided between the main pipe and the expanded pipe portion and has an internal diameter gradually increased from one end of the main pipe, and the insertion of the main pipe of the second pole may be restricted due to the inclined portion of the first pole.

The insert connector may include an inserted portion inserted into the main pipe, and an exposed portion exposed at the outside of the main pipe.

A length of the inserted portion may be greater than that of the expanded pipe portion.

A length of the inserted portion may be greater than that of the exposed portion.

The insert connector may be bond-coupled or forcibly press-fitted to the main pipe.

The main pipe may have a predetermined external diameter and a predetermined internal diameter.

A thickness of the insert connector may be greater than that of the main pipe.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION

Figure 1:
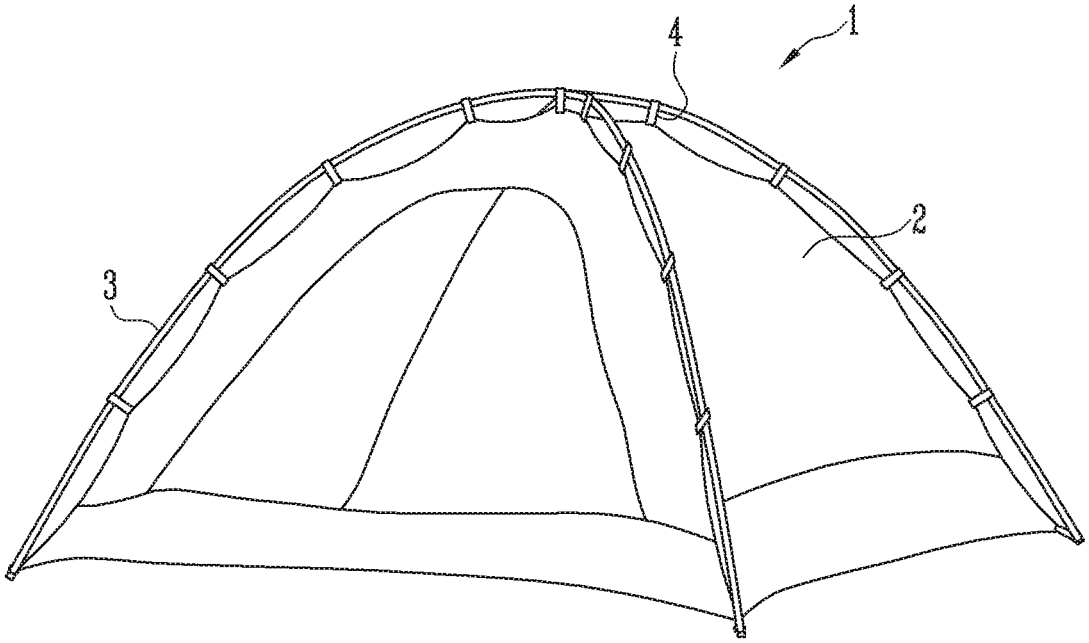
FIG. 1 is a view illustrating a tent in which tent poles according to one embodiment of the present invention is used.

Purposes, specific advantages, and novel features of the present invention will be clear from exemplary embodiments and the following detailed descriptions in connection with the accompanying drawings. In this specification, when reference numerals are assigned to components of each drawing, it should be noted that, the same numerals are assigned to the same components even when the same components are illustrated in different drawings whenever possible. In descriptions of the present invention, when detailed descriptions of related well-known technology are deemed to unnecessarily obscure the gist of the present invention, they will be omitted.

Hereinafter, exemplary embodiments of the present invention will be described with reference to the accompanying drawings in detail.

Figure 2:
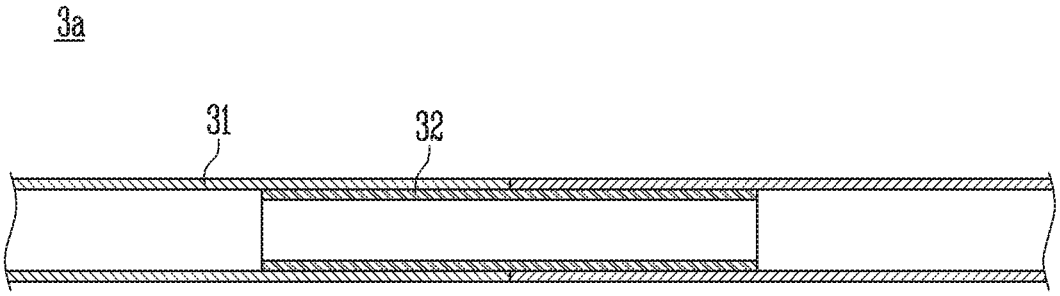
FIGS. 2 to 4 are cross-sectional views illustrating tent poles according to the related art.

For convenience of explanation, the term 'one end' used in the specification refers to a right end of a main pipe (11, 21, 31, 33, or 36) as shown in FIG. 2, and the 'the other end' refers to a left end thereof as shown in FIG. 2. However, the present invention is not limited thereto.

FIG. 1 is a view illustrating a tent in which tent poles according to one embodiment of the present invention is used.

Referring to FIG. 1, a tent 1 includes a fabric sheet 2 having a predetermined form, for example, a dome form, and tent poles 3. As illustrated in FIG. 1, the plurality of tent poles 3 may be connected to each other to form a structure corresponding to the fabric sheet 2, or the tent poles 3 connected in series may be bent to correspond to the shape of the fabric sheet 2, and inserted into connecting rings 4 of the fabric sheet 2 to maintain a predetermined form of the fabric sheet 2 due to an elastic force of each of the tent poles 3.

Here, the tent 1 may have various forms according to a use and a structure, and a detailed description thereof will be omitted. In the present embodiment, the form of the tent 1 is shown as an example, and the present invention may be applied to any structure capable of using the tent pole 3.

Figure 3:
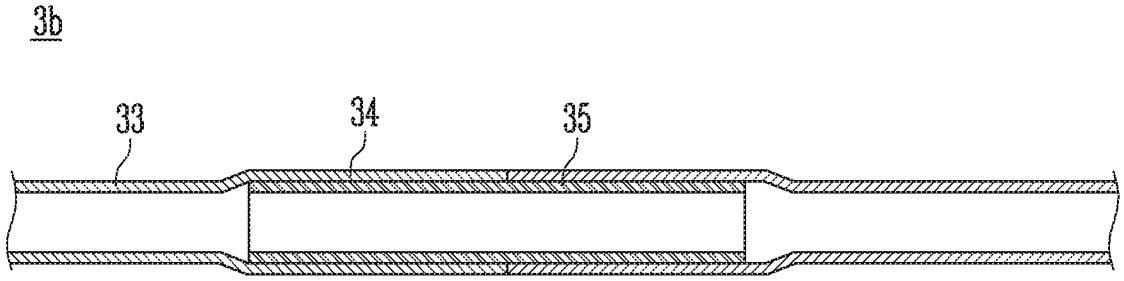
Figure 4:
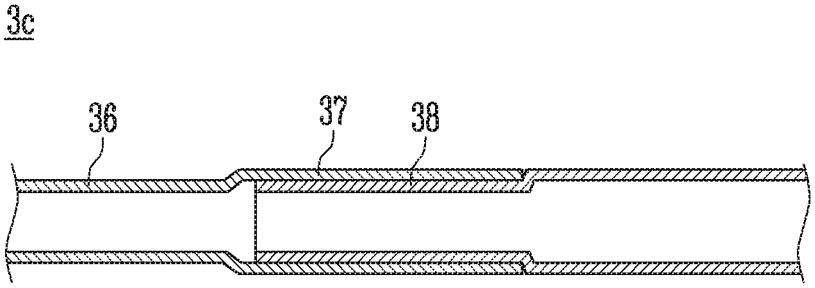

FIGS. 2 to 4 are cross-sectional views illustrating tent poles according to the related art.

For the sake of convenience, a connecting portion between two poles which are adjacent among a plurality of poles included in the tent poles is illustrated in each of the following drawings, but the tent pole may have a connecting structure in which illustrated structures are repeated in a longitudinal direction.

In addition, since the plurality of poles forming the tent poles actually have the same structure, repeated descriptions will be omitted and one pole will be mainly described.

The tent pole according to the related art generally has one of the following three forms.

1) Standard Pipe

Referring to FIG. 2, a tent pole 3*a* having a standard pipe structure includes main pipes 31, in which each pole has a predetermined external diameter, and has a structure in which two main pipes 31 are connected by a connector 32.

The main pipe 31 has a cylindrical form which does not include an expanded or shrunken pipe portion, has the predetermined external diameter, and straightly extends.

One portion of the connector 32 is coupled to an end of the main pipe 31, and the other part of the connector 32 is inserted into the main pipe 31 of another pole. That is, two poles are coupled by the connector 32.

In a state in which the connector 32 is connected to the end of the main pipe 31, the connector 32 may be inserted into the main pipe 31 of another pole. Here, the connector 32 may be connected to the main pipe 31 through a press-fitting, bonding, or punching method.

Since the tent pole 3*a* according to the present embodiment is easy to manufacture and wages therefor are low, the tent pole 3*a* has been most widely used.

2) Two-Way Expanded Pipe

Referring to FIG. 3, a tent pole 3*b* having a two-way expanded pipe structure has a structure in which an expanded pipe portion 34 is formed on an end of a main pipe 33 and a connector 35 is inserted into expanded pipe portions 34 of two poles.

The expanded pipe portions 34 may be formed to have the same structure on both ends of the main pipe 33.

The expanded pipe portion 34 is a portion having an increased internal diameter from one end of the main pipe 33. That is, an internal diameter of the expanded pipe portion 34 is greater than that of the internal diameter of the main pipe 33, and the internal diameter of the expanded pipe portion 34 may have a size corresponding to an external diameter of the connector 35.

A part of the connector 35 is coupled to the expanded pipe portion 34, and the other part of the connector 35 is inserted into the expanded pipe portion 34 of another pole. That is, the expanded pipe portions 34 of two poles are coupled to each other by the connector 35.

In a state in which the connector 35 is connected to the expanded pipe portion 34 of any one pole, the connector 35 may be inserted into the expanded pipe portion 34 of another pole. Here, the connector 35 is typically connected to the expanded pipe portion 34 through press-fitting or bonding.

In the tent pole 3*b* according to the present embodiment, since the external diameter of the connector 35 is large, a strength of a joint portion is high when compared to the standard pipe product, but a problem of cracks may occur at an end of the expanded pipe portion 34.

In order to supplement this problem, a ring may also be inserted into the tent pole 3*b*.

3) Expanded & Shrunken Pipe

Referring to FIG. 4, a tent pole 3*c* having an expanded and shrunken pipe structure has a structure in which an expanded pipe portion 37 is formed from one end of a main pipe 36, a shrunken pipe portion 38 is formed from the other end, and the expanded pipe portion 37 and the shrunken pipe portion 38 of two poles are coupled.

The expanded pipe portion 37 is a portion having an increased internal diameter from one end of the main pipe 36, and the shrunken pipe portion 38 is a portion having a decreased internal diameter from the other end of the main pipe 36. The internal diameter of the expanded pipe portion 37 has a size corresponding to the external diameter of the shrunken pipe portion 38, and the external diameter of the shrunken pipe portion 38 has a size corresponding to the internal diameter of the expanded pipe portion 37.

The tent pole 3*c* according to the present embodiment has advantages in that a wage for press-fitting is saved and a weight is reduced because a connector is omitted.

Other products having other structures other than the above-described three tent poles 3*a*, 3*b*, and 3*c* may be present. However, products advanced from the group including the three products have not been come out yet.

Particularly, when each of the tent poles is bent, a tensile force is generated at the end of the connector, the joint portion between the main pipe and the expanded pipe portion or between the expanded pipe portion and the shrunken pipe portion, and the like, thereby causing a crack point.

Figure 5A:
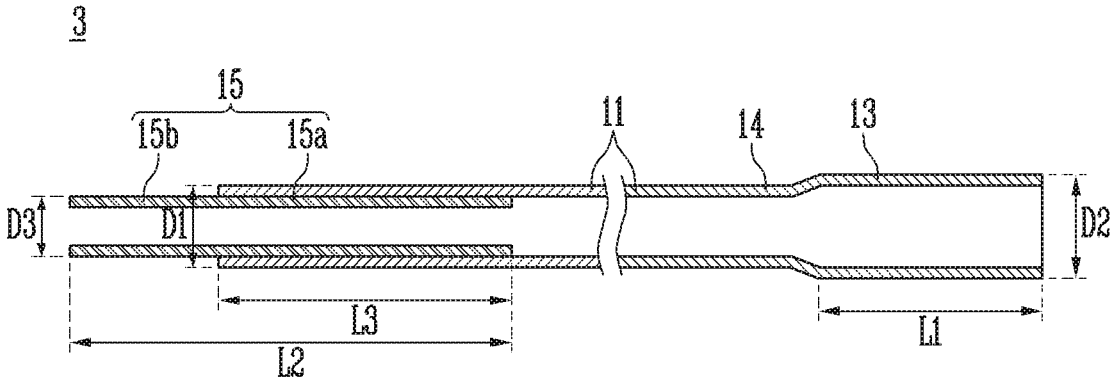
FIGS. 5A to 5C are cross-sectional views illustrating the tent pole according to one embodiment of the present invention.
Figure 5B:
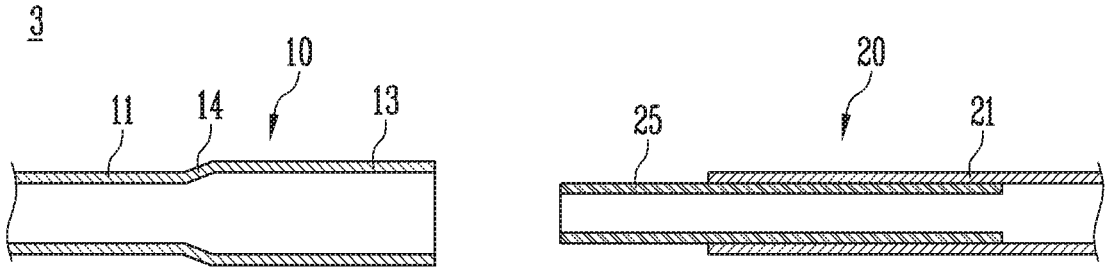
Figure 5C:
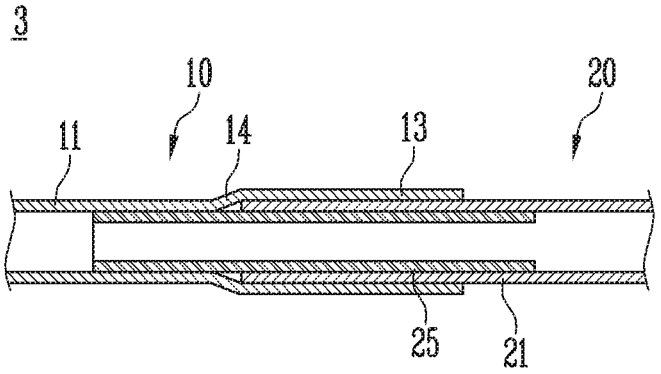

FIGS. 5A to 5C are cross-sectional views illustrating a tent pole according to one embodiment of the present invention.

Referring to FIGS. 5A, 5B, and 5C, a tent pole 3 according to one embodiment of the present invention has a structure in which a plurality of poles are coupled in a longitudinal direction, and two poles which are coupled among the plurality of poles refer to a first pole 10 and a second pole 20.

In addition, since the first pole 10 and the second pole 20 have the same structure, repeated descriptions will be omitted and the first pole 10 will be mainly described.

In addition, the tent pole 3 may have a structure in which an elastic strap (not shown) passes through insides of the plurality of poles so that the poles are connected to each other even in a state in which the poles are separated from each other.

The first pole 10 may include a main pipe 11, an expanded pipe portion 13, an inclined portion 14, and an insert connector 15.

The main pipe 11 is a pipe forming a body of the pole, may have a cylindrical pipe form having predetermined external and internal diameters, and may be manufactured of high strength aluminum, fiber reinforced plastic (FRP), steel, or carbon.

For example, the main pipe 11 may have an external diameter D1 of 8.5 mm, an internal diameter of 7.1 mm, and a length of 200 mm.

The expanded pipe portion 13 is a portion having an increased internal diameter from one end of the main pipe 11. That is, the internal diameter of the expanded pipe portion 13 is greater than that of the main pipe 11, and the internal diameter of the expanded pipe portion 13 may have a size corresponding to the external diameter of the main pipe 11. The expanded pipe portion 13 and the main pipe 11 may be formed of the same material and have an integrated structure.

For example, the expanded pipe portion 13 may have an external diameter D2 of 10 mm, an internal diameter of 8.6 mm, and a length L1 of 30 mm.

The inclined portion 14 is provided between the main pipe 11 and the expanded pipe portion 13, and has a tapered form having a gradually increasing internal diameter from one end of the main pipe 11. However, an angle of the inclined portion 14 may be variously set gently or sharply as necessary.

The insert connector 15 is insertion-coupled to the other end of the main pipe 11, and a portion of the insert connector 15 is exposed at an outside of the main pipe 11. That is, the insert connector 15 is coupled to a side opposite to the expanded pipe portion 13, and a portion of the insert connector 15 is inserted into the main pipe 11, and the other portion is exposed at the outside of the main pipe 11.

A material of the insert connector 15 may be the same as that of the main pipe 11, and the insert connector 15 and the main pipe 11 may be separate parts which are separately manufactured. The separately manufactured insert connector 15 may be bond-coupled or forcibly press-fitted to the main pipe 11.

In order to insert the insert connector 15 into the main pipe 11, an external diameter of the insert connector 15 may have a size corresponding to the internal diameter of the main pipe 11. In addition, in order to improve strength, a thickness of the insert connector 15 may be greater than that of the main pipe 11.

For example, the insert connector 15 may have an external diameter D3 of 7 mm, an internal diameter of 5 mm, and a length L2 of 60 mm.

The insert connector 15 may include an inserted portion 15*a* inserted into the main pipe 11 and an exposed portion 15*b* exposed at the outside of the main pipe 11. That is, the inserted portion 15*a* is one portion, which is inserted into the main pipe 11, of the insert connector 15, and the exposed portion 15*b* is another portion, which is not inserted into the main pipe 11 and is exposed at the outside, of the insert connector 15.

According to one embodiment, a length L3 of the inserted portion 15*a* may be greater than the length L1 of the expanded pipe portion 13. In addition, the length L3 of the inserted portion 15*a* may be greater than a length of the exposed portion 15*b*.

For example, in a case in which the expanded pipe portion 13 has the length L1 of 30 mm, and the insert connector 15 has the entire length L2 of 60 mm, the inserted portion 15*a* may have the length L3 of 40 mm, and the exposed portion 15*b* may have a length of 20 mm.

Hereinafter, an example will be described in which the first pole 10 and the second pole 20 are coupled. Here, the second pole 20 and the first pole 10 have the same structure.

Referring to FIGS. 5B and 5C, the other end of a main pipe 21 of the second pole 20 is inserted into the expanded pipe portion 13 of the first pole 10. At this moment, an insert connector 25 has been coupled to the main pipe 21 of the second pole 20. When the first pole 10 and the second pole 20 are coupled, the insert connector 25 of the second pole 20 passes through the expanded pipe portion 13 of the first pole 10 and is inserted into the main pipe 11 of the first pole 10 at a predetermined depth.

In a state in which the main pipe 21 of the second pole 20 is inserted into the expanded pipe portion 13 of the first pole 10, an end of the main pipe 21 is guided along an inside of the expanded pipe portion 13 to be smoothly inserted thereinto. In addition, the insertion of the main pipe 21 of the second pole 20 is restricted due to the inclined portion 14 of the first pole 10.

When the first pole 10 and the second pole 20 are completely coupled, one portion of the insert connector 25 of the second pole 20 and the main pipe 21 of the second pole 20 are supportedly disposed inside the expanded pipe portion 13 of the first pole 10, and the other portion of the insert connector 25 is supportedly disposed inside the main pipe 11 of the first pole 10.

According to such a coupling structure, a state in which the first pole 10 and the second pole 20 are stably coupled is maintained, and the insert connector 25 of the second pole 20 also covers all of total and surrounding regions of the expanded pipe portion 13 of the first pole 10, that is, an end portion of the first pole 10 and an end portion of the second pole 20 which have high risks of cracks due to bending.

That is, the tent pole 3 according to the present invention serves to distribute a force by double supporting an area which is larger than that of a structure of each of the tent poles 3*a*, 3*b*, and 3*c*.

As described above, the connecting structure of the tent pole 3 according to the present invention reinforces a connecting portion between the poles using the insert connector when compared to a connecting structure of the conventional tent pole, and thus a strength of a joint portion can be improved to prevent cracks and damage.

Figure 6:
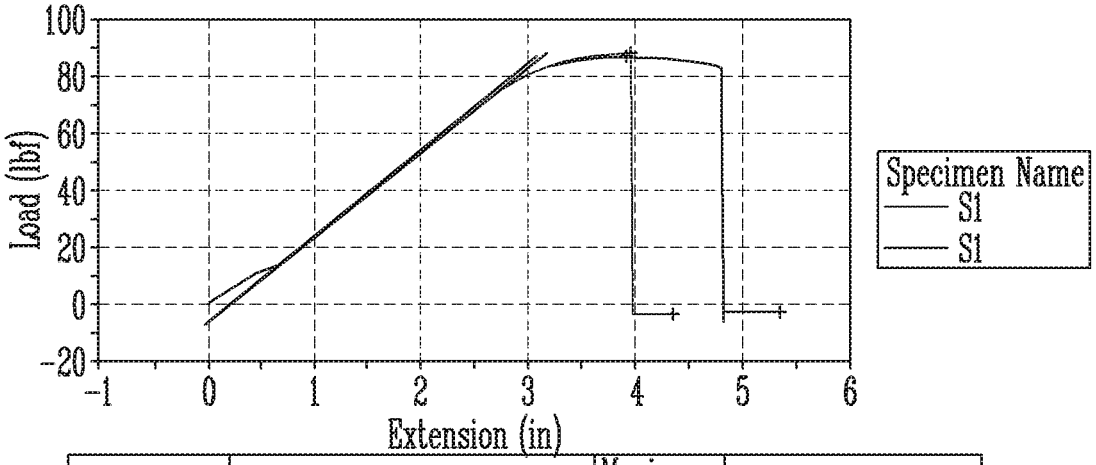
FIG. 6 is a view showing an experimental example of the tent pole according to the present invention.
Figure 7:
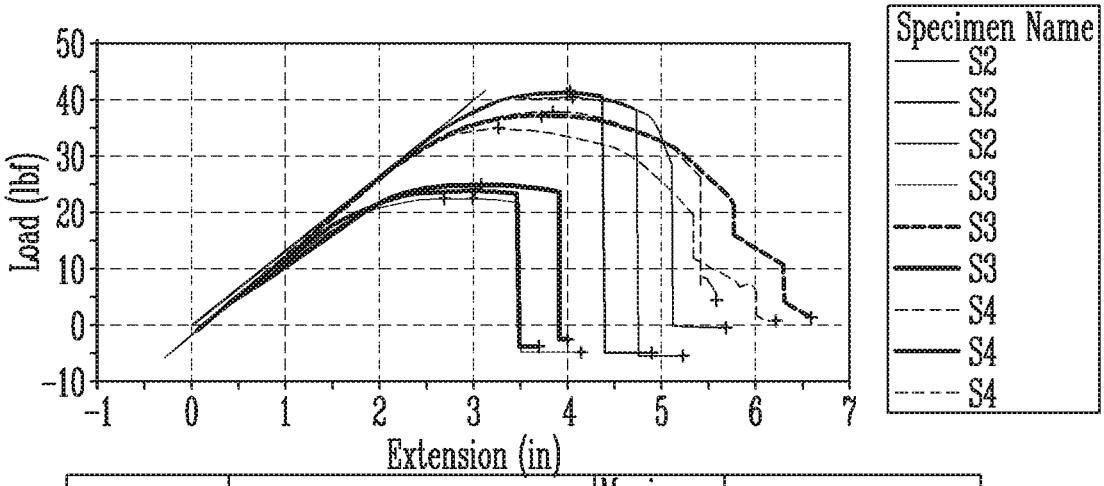
FIG. 7 is a view showing an experimental example of tent poles according to the related art.

FIG. 6 is a view showing an experimental example of the tent pole according to the present invention, and FIG. 7 is a view showing an experimental example of tent poles according to the related art.

Referring to FIGS. 6 and 7, the results of tensile tests for comparing strengths of connecting portions of tent poles are shown in tables. Here, Si denotes the tent pole 3 according to the present invention, S3 refers to the tent pole 3*a* having the standard pipe structure, and S4 denotes the tent pole 3*c* having the expanded and shrunken pipe structure.

When the result values (maximum load and load at yield) of Si, S3, and S4 are compared on the basis of the tensile tests performed a plurality of times, it may be seen that Si had the largest values and was highest from a view point of strength.

Specifically, in the tent poles S3 and S4 according to the related art, when the tent poles were bent in certain forms, there was a problem in that the connecting portion between the poles, and portions from which the pipe was expanded and shrunken were bent and damaged, or coupling forces thereof were decreased.

However, in the tent pole Si according to the present invention, since the insert connector was deeply inserted into the expanded pipe portion and the main pipe, a contact area was increased, and even when the tent pole 3 was bent, a force applied to the connecting portion was distributed to the expanded pipe portion and the main pipe, and also distributed to the insert connector which was supportedly disposed inside the expanded pipe portion and the main pipe, and thus bending properties were improved and a lifespan of a product was able to be increased.

As described above, in a tent pole according to the present invention, since a connecting portion between poles is widened and reinforced using an insert connector, the strength of a joint portion is improved to prevent cracks and damage.

In addition to the above-described embodiment, the present invention includes any embodiment derived by combining at least one of the embodiments and a known technology or combining at least two of the embodiments.

The present invention has been described in detail with reference to the exemplary embodiments. However, the exemplary embodiments should be considered in a descriptive sense only, and the present invention is not limited thereto. It should be clear to those skilled in the art that various modifications and improvements within the scope of the invention may be made.

Simple modifications and alterations of the present invention fall within the scope of the present invention which is defined by the accompanying claims.

What is claimed is:

1. A tent pole comprising:

a first pole and a second pole, wherein each of the first and second poles includes: a main pipe, and an expanded pipe portion at one end of the main pipe, the expanded pipe portion having an increased internal diameter from the main pipe, wherein the second pole includes an insert connector inserted in the other end of the main pipe from the expanded portion of the second pole, the insert connector including an insert portion inserted inside the main pipe of the second pole and an exposed portion outside of the main pipe of the second pole, wherein the other end of the main pipe of the second pole is inserted into the expanded pipe portion of the first pole, and the exposed portion of the insert connector of the second pole is inserted inside the first pole through the expanded pipe portion of the first pole into the main pipe of the first pole to a predetermined depth.

2. The tent pole of claim 1, further comprising an inclined portion which is provided between the main pipe and the expanded pipe portion and has an internal diameter gradually increased from one end of the main pipe, wherein the insertion of the main pipe of the second pole is restricted due to the inclined portion of the first pole.

3. The tent pole of claim 1, wherein a length of the inserted portion is greater than that of the expanded pipe portion.

4. The tent pole of claim 1, wherein a length of the inserted portion is greater than that of the exposed portion.

5. The tent pole of claim 1, wherein the insert connector is bond-coupled or forcibly press-fitted to the main pipe.

6. The tent pole of claim 1, wherein the main pipe has a predetermined external diameter and a predetermined internal diameter.

7. The tent pole of claim 1, wherein a thickness of the insert connector is greater than that of the main pipe.

* * * * *